US006696796B2

(12) United States Patent
Park

(10) Patent No.: US 6,696,796 B2
(45) Date of Patent: Feb. 24, 2004

(54) PLASMA DISPLAY PANEL HAVING PRESSURE ADJUSTING MEANS AND METHOD OF ADJUSTING PRESSURE

(75) Inventor: Hun Gun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/139,640

(22) Filed: May 7, 2002

(65) Prior Publication Data

US 2002/0180373 A1 Dec. 5, 2002

(30) Foreign Application Priority Data

May 7, 2001 (KR) ..... 2001-24585

(51) Int. Cl.[7] ..... G09G 3/10

(52) U.S. Cl. ..... 315/169.4; 445/24; 445/25; 445/58

(58) Field of Search ..... 315/169.4, 169.1, 315/111.91; 313/495, 586; 445/24, 25, 53, 56, 58, 72, 73; 428/34; 156/109; 65/43

(56) References Cited

U.S. PATENT DOCUMENTS 5,041,760 A * 8/1991 Koloc ..... 315/111.41
5,985,069 A * 11/1999 Kawabe et al. ..... 156/109
6,547,617 B1 * 4/2003 Kawamura et al. ..... 445/24
2002/0146959 A1 * 10/2002 Park et al. ..... 445/25

* cited by examiner

*Primary Examiner*—Haissa Philogene
(74) *Attorney, Agent, or Firm*—Fleshner & Kim, LLP

(57) ABSTRACT

A plasma display panel, including a pair of substrates arranged having a predetermined distance between them, a plurality of first electrodes formed on one of the substrates and a plurality of second electrodes formed at a predetermined interval on the other substrate, wherein the second electrodes intersect the first electrodes. The panel further includes a dielectric covering the first and second electrodes, wherein the dielectric is formed on each of the pair of substrates, a barrier rib formed between the pair of substrates and a phosphor layer coated on the barrier rib, wherein discharge cells are formed at the intersections of the first and second electrodes. The panel also has a sealant coated on marginal portions of the panel that seals the panel, a discharge gas injected with a predetermined pressure into the inside of the panel, and a pressure adjusting means for adjusting the pressure of the injected discharge gas in the plasma display panel.

29 Claims, 4 Drawing Sheets

Low land = General altitude Alpine area

PLASMA DISPLAY PANEL HAVING PRESSURE ADJUSTING MEANS AND METHOD OF ADJUSTING PRESSURE

BACKGROUND OF THE INVENTION

1. Field of the Invention

The present invention relates to a plasma display panel and method of adjusting pressure.

2. Background of the Related Art

FIG. 1 illustrates a related art AC surface discharge plasma display panel (PDP). As shown in FIG. 1, the related art AC surface discharge plasma display panel includes a back glass substrate 20, address electrodes A" formed on the back glass substrate 20, and a dielectric layer 23 covering the address electrodes A". It also includes a front glass substrate 10 placed opposite to the back glass substrate 20, pairs of sustain electrodes X and Y arranged in parallel on the front glass substrate, a dielectric layer 12 covering the pairs of sustain electrodes, and an MgO protection layer 13 formed on the dielectric layer 12.

Also, the panel includes barrier ribs 21 arranged between the front and back glass substrates 10 and 20 to define discharge spaces, and a phosphor layer 24 coated on the barrier ribs 21. The sustain electrodes X and Y have transparent ITO (Indium Tin Oxide) electrodes Xa and Ya and bus electrodes Xb and Yb placed on one side of the ITO electrodes, respectively.

FIG. 2 illustrates the related art AC PDP, shown in FIG. 1, sealed with a sealant. A cut-off exhaust pipe 30 is shown on the backside of the PDP.

In general, the process of fabricating a plasma display panel includes forming a front substrate 10, forming pairs of sustain electrodes X and Y on the front substrate, covering the pairs of sustain electrodes X and Y with a dielectric layer 12 and forming the MgO protection layer 13 on the dielectric layer 12. Next, a back substrate 20 is formed with a plurality of address electrodes A" formed thereon wherein the address electrodes A" are covered with a dielectric layer 23. Barrier ribs 21 are then formed on the dielectric layer 23 to define discharge spaces with a phosphor layer 24 formed between the barrier ribs 21.

Finally, the PDP is completed by sealing up marginal portions of the front and back substrates using a sealant to attach the two substrates to each other and injecting gas to evacuate the inside of the plasma display panel assembly through a exhaust pipe 30 by injecting Ne gas containing some Xe into the inside of the assembly. The gas is injected until an internal pressure of approximately 400–600 Torr is reached. When the desired pressure of the discharge gas is achieved, the PDP is completely sealed to maintain a constant and fixed permanent internal amount of gas by cutting off the exhaust pipe 30, wherein the amount of gas present can no longer be changed.

When discharge gas is injected into the inside of the plasma display panel and the exhaust pipe is cut off to seal up the panel, the plasma display panel maintains a fixed, uniform amount of gas, which cannot be changed without breaking the seal on the panel. Further, if the panel is used in the same ambient pressure, the pressure in the panel is maintained. However, one problem that arises is that use may occur anywhere in the world including areas with different external environments and different ambient pressures. For example, while ambient pressure is 760 Torr at sea level, it is about 500 Torr at 3000 m above sea level, such as in the high altitude alpine zones of Mexico or South America.

These variations in ambient pressure can lead to problems since the amount of gas present will always be the amount present when at sea level with the pressure of the gas injected into the inside of a panel is 400–600 Torr. However, as illustrated in FIG. 3., when the external pressure is reduced, like in a high altitude alpine area, the pressure of gas injected into the inside of the panel can cause the gap between the front and back substrates of the panel to increase due to the change in external pressure. This gap can lead to free movement of charges and a variation in the distance between the front and back substrates possibly generating spaces between the tops of the barrier ribs and the front substrate which can lead to partial crosstalk or generating distortions in the panel which can lead to an image change or general panel distortion. Furthermore, when the external temperature varies, gas pressure inside the panel can also change, and thus may generate problems similar to those created when the altitude is varied.

As described above, in the related art plasma display panel, the pressure ratio between discharge gas pressure to atmospheric pressure varies according to a variation in external environments, whereby affecting initially set discharge conditions and, consequently, can deteriorate picture quality.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

An object of the present invention is to provide a plasma display panel having a means for adjusting discharge gas pressure.

To accomplish the object of the present invention, there is provided a plasma display panel, including a pair of substrates arranged having a predetermined distance between them, a plurality of first electrodes formed on one of the substrates, a plurality of second electrodes formed at a predetermined interval on the other substrate, wherein the second electrodes intersect the first electrodes, a dielectric covering the first and second electrodes, wherein the dielectric is formed on each of the pair of substrates, a barrier rib formed between the pair of substrates, a phosphor layer coated on the barrier rib, wherein discharge cells are formed at the intersections of the first and second electrodes, a sealant coated on marginal portions of the panel that seals the panel, a discharge gas injected with a predetermined pressure into the inside of the panel, and a pressure adjusting means for adjusting the pressure of the injected discharge gas in a sealed plasma display panel.

Another object of the present invention is to provide a pressure adjusting means integrated with an exhaust pipe that evacuates the inside of the sealed panel and injects the gas into the panel.

Another object of the present invention is to provide a pressure adjusting means which includes a case attached to the panel with an opening which connects the case with the inside of the panel, and a volume varying means for varying the volume of the case.

Another object of the present invention is to provide a case with two branches, one of which is an exhaust pipe and the other one of which has the volume varying means inserted therein.

Another object of the present invention is to provide a plasma display panel, including a pair of substrates having a predetermined distance between them, a plurality of first electrodes on one of the substrates, a plurality of second electrodes on the other substrate, barrier ribs formed on one of the substrates forming discharge cells, discharge gas injected into the panel with a predetermined pressure, and a re-adjustable pressure adjustor connected to the panel, wherein the adjustor can fixedly adjust the discharge gas initially upon formation of the panel and can readjust the pressure within the panel at least one other time after completed formation.

Another object of the present invention is to provide a plasma display panel, including a pair of substrates having a predetermined distance between them, a plurality of first electrodes on one of the substrates, a plurality of second electrodes on the other substrate, barrier ribs formed on one of the substrates forming discharge cells, discharge gas injected into the panel with a predetermined pressure, and a pressure adjustor connected to the discharge gas, wherein the plasma display panel and the pressure adjustor are sealed together and the pressure of the discharge gas in the plasma display panel can be fixed and later either readjusted without breaking the seal or readjusted by breaking the seal and allowing the seal to re-seal without intervention.

Another object of the present invention is to provide a method of correcting for environmental effects on a plasma display panel including changing an internal pressure of a plasma display panel initially set by a manufacturer.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
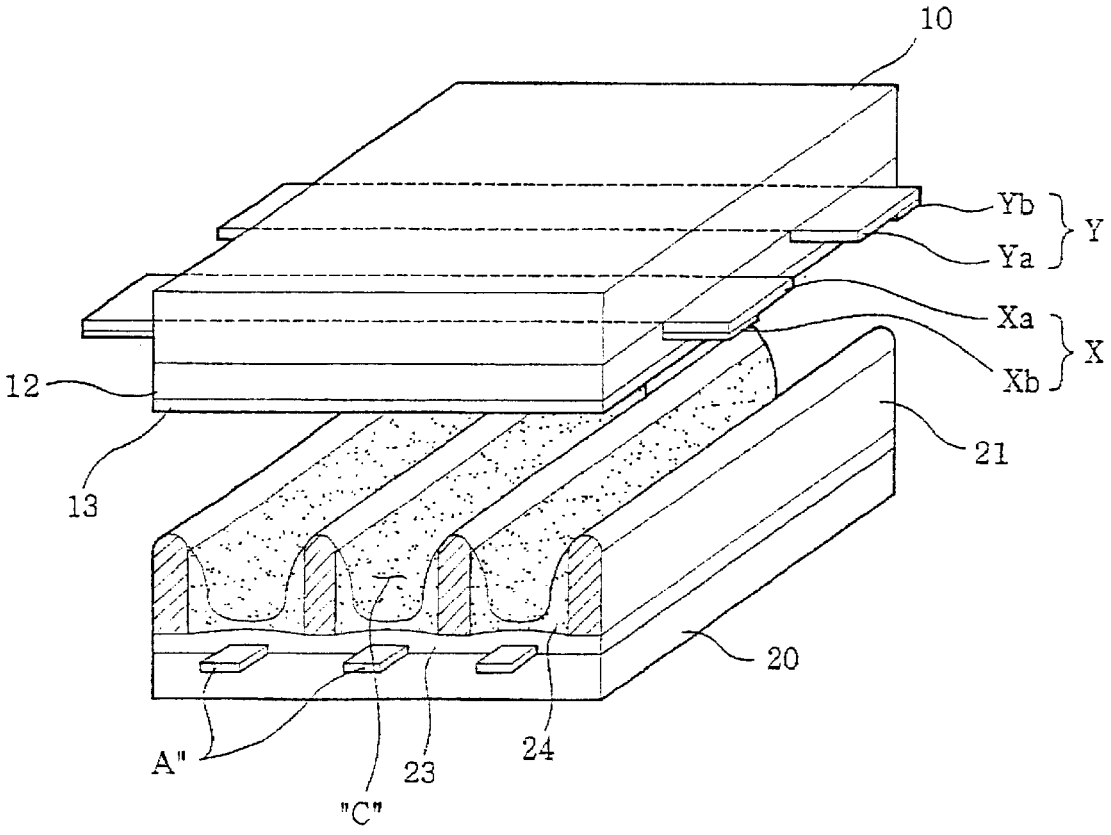
FIG.1 (Related Art)
FIG. 1 illustrates a configuration of a related art AC surface discharge PDP.
Figure 2:
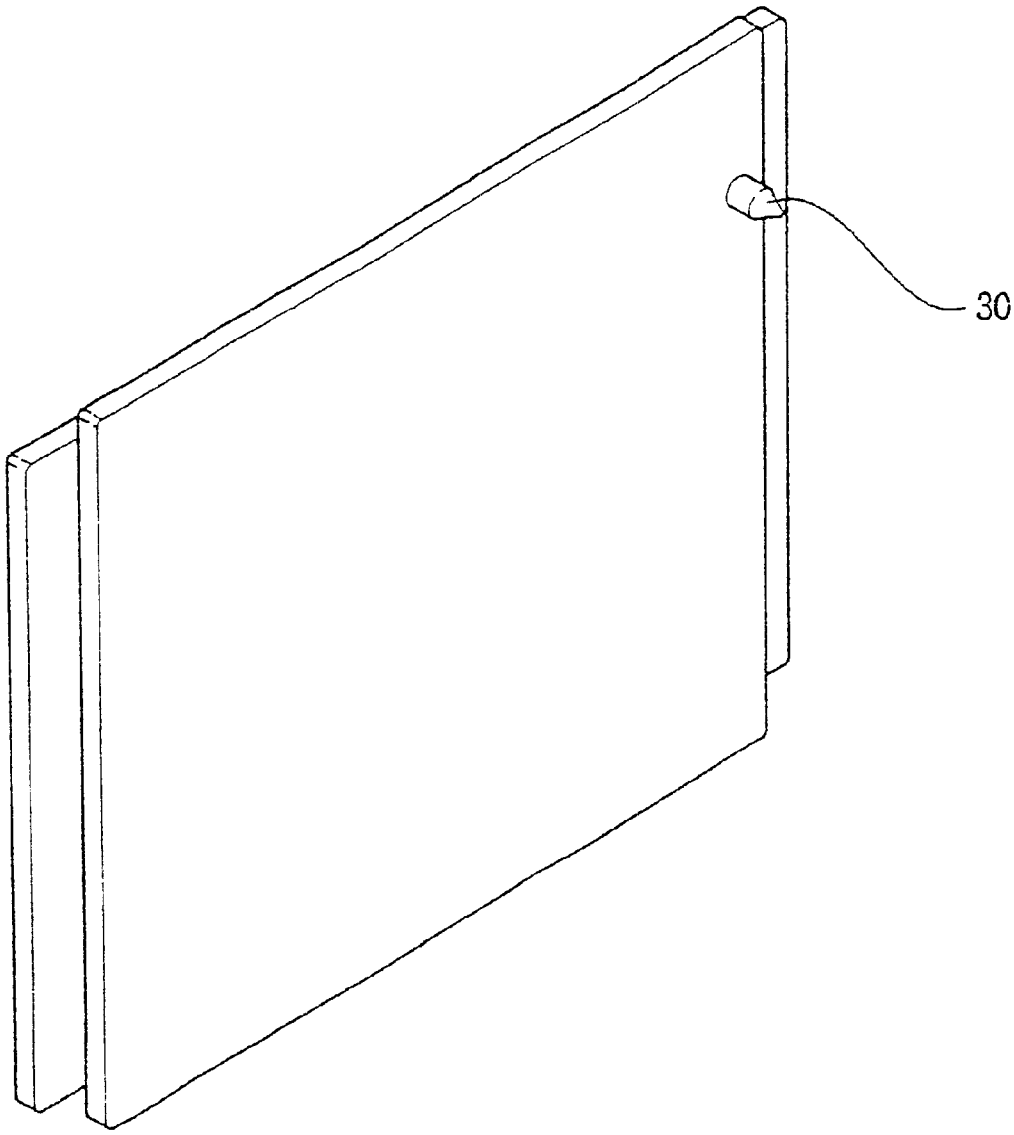
FIG. 2 (Related Art)
FIG. 2 illustrates the backside of the related art PDP.
Figure 3:
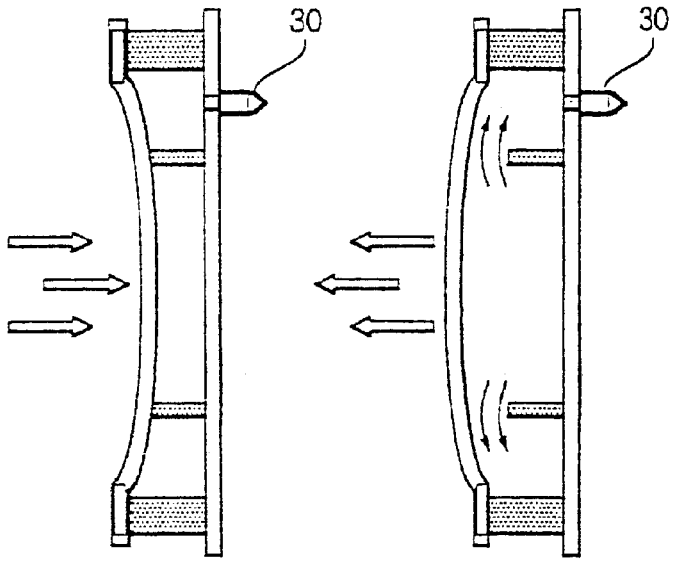
FIG. 3 illustrates variations in the related art PDP according to a variation in atmospheric pressure.
Figure 4:
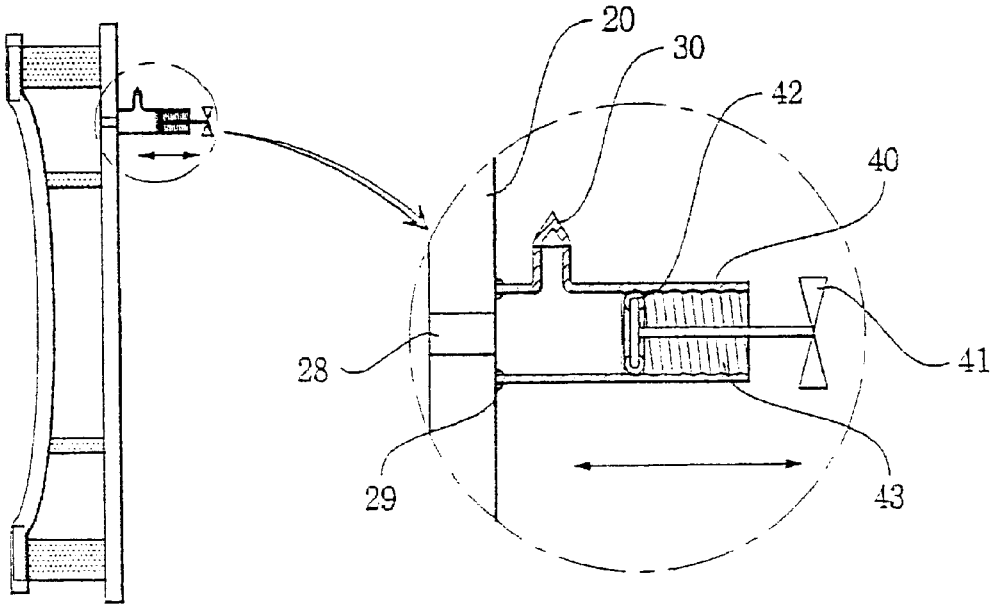
FIG. 4 illustrates a PDP having a discharge gas adjusting means according to a preferred embodiment of the present invention.

FIG. 4 illustrates a plasma display panel (PDP) with a discharge gas pressure adjusting means according to a preferred embodiment of the invention. Referring to FIG. 4, an exhaust pipe 30, which can be sealed or can serve as an exhaust passage and discharge gas injection hole, and a volume varying means 40 are attached to a portion of the PDP around a through-hole 28 formed in a back glass substrate 20 by a sealant 29 such as frit glass. It is preferable that the exhaust pipe 30 and volume varying means 40 are integrated with each other, as shown in FIG. 4, but they can be formed separately from each other.

The volume varying means 40 can be of any conformation to adjust the volume of the discharge gas, but in this preferred embodiment, includes a screw adjustor that can move forward and backward in a screw-like manner. The volume varying means 40 can be fastened to any portion of the PDP, but is preferably fastened to the back substrate 20 for aesthetic reasons.

The volume varying means 40 preferably maintains a constant amount of discharge gas in the PDP, but allows for the volume of the PDP to be adjusted and thus, the pressure to be adjusted. A preferable way to adjust the volume and therefore the pressure is to use a circular rubber packing 42 attached to the end of a handle grip 41 inserted into a tube having a screw thread 43 formed thereon. When the volume varying means 40 decreases the total volume of gas in the PDP by moving forward in the direction towards the PDP, the discharge gas in the exhaust pipe 30 and the PDP in general is compressed so that the pressure of the discharge gas in the PDP increases. On the other hand, when the volume varying means 40 moves away from the PDP, the discharge gas pressure decreases as the volume has increased. In fact, the pressure in the plasma display panel can be varied any amount depending on the size of the exhaust pipe 30 and the volume varying means 40. However, the pressure is preferably adjusted about 200–1000 Torr, more preferably 400–600 Torr, only by adjusting the pressure of discharge gas in the sealed exhaust pipe 30 because the volume of the discharge space inside the plasma display panel is not large.

The exhaust pipe 30 and volume varying means 40 can be fabricated using a glass or ceramic pipe, a plastic pipe, a metal pipe, a composite pipe or any other suitable pipe, as shown in FIG. 4. In the case where the exhaust pipe 30 and volume varying means 40 are fabricated using glass, they can be easily attached to the back glass substrate 20 using frit glass and the exhaust pipe 30 can simply be sealed after exhaustion of the ambient air from manufacture and injection of the discharge gas.

The volume varying means 40 can also be easily fabricated and sealed up when it is formed using various materials such as ceramics, plastics and metals either separately or together. The volume varying means 40 according to the present invention is not limited to the structure shown in FIG. 4, and can be fabricated and installed in various forms. For example, it can be formed on a front glass substrate 10 or any exterior surface of the PDP.

Figure 5:
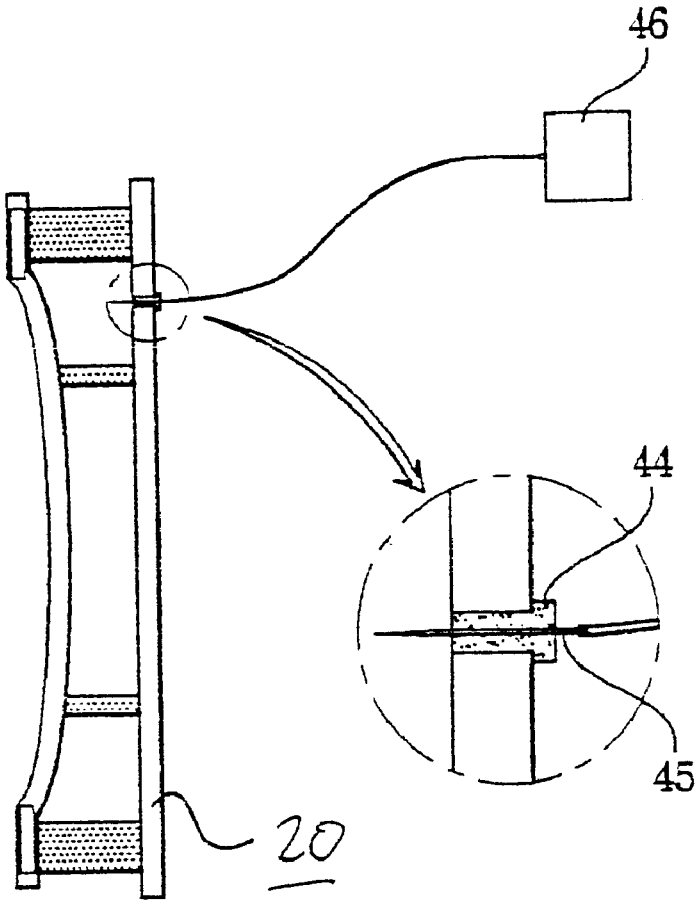
FIG. 5 illustrates a PDP having a discharge gas adjusting means according to another preferred embodiment of the present invention.

FIG. 5 illustrates a PDP having a discharge gas pressure adjusting means according to another preferred embodiment of the invention. Referring to FIG. 5, an opening is formed in a portion of a back substrate 20, although it can be formed on any exterior surface of the PDP, but is formed on the back substrate 20 for aesthetic reasons. The opening can then be shielded with a self-sealing body, such as an elastic body 44 like raw rubber or other elastomer. Next, to adjust the discharge gas pressure, a penetrating tube 45, such as an injection needle, can be inserted into the self-sealing body to inject or extract the discharge gas into/from the inside of a panel. In order to adjust the discharge gas pressure an external discharge gas injection and extraction means 46, such as a suction and exhaust pump, can be used to control the pressure of the discharge gas in the PDP to a desired pressure level.

Although the self-sealing or elastic body is exemplified to seal the opening of the panel in the aforementioned embodiment, other various configurations capable of injecting or extracting the discharge gas into/from the inside of the panel in a way similar to the above one can also be employed, such as any seal that can self seal after a penetrating tube is inserted and removed.

According to the present invention, the discharge gas pressure can be controlled depending on the environment where the plasma display panel is used. Thus, in using the preferred embodiments of the invention, a variation in atmospheric pressure or temperature change would not, in and of itself, have to affect the characteristics of the PDP, as any such resulting atmospheric pressure change could be compensated for by the pressure adjusting means.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A plasma display panel, comprising:

a pair of substrates arranged having a predetermined distance between them;

a plurality of first electrodes formed on one of the substrates;

a plurality of second electrodes formed at a predetermined interval on the other substrate, wherein the second electrodes intersect the first electrodes;

a dielectric covering the first and second electrodes, wherein the dielectric is formed on each of the pair of substrates;

a barrier rib formed between the pair of substrates;

a phosphor layer coated on the barrier rib, wherein discharge cells are formed at the intersections of the first and second electrodes;

a sealant coated on marginal portions of the panel that seals the panel;

a discharge gas injected with a predetermined pressure into the inside of the panel; and a pressure adjusting means for adjusting the pressure of the injected discharge gas in the plasma display panel.

2. The plasma display panel as claimed in claim 1, wherein the pressure adjusting means has an exhaust pipe that allows for the evacuation of the inside of the panel and allows for the gas to be injected into the panel.

3. The plasma display panel as claimed in claim 1, wherein the discharge gas pressure is adjustable from about 200 to about 1000 Torr.

4. The plasma display panel as claimed in claim 3, wherein the discharge gas pressure is adjustable from about 400 to about 600 Torr.

5. The plasma display panel as claimed in claim 1, wherein the pressure adjusting means comprises:

a case attached to the panel with an opening which allows discharge gas to flow between the case and the inside of the panel; and a volume varying means for varying the volume of the case and the panel.

6. The plasma display panel as claimed in claim 5, wherein the case is a glass exhaust pipe.

7. The plasma display panel as claimed in claim 5, wherein the case is made of ceramic, metal, plastic and/or composite.

8. The plasma display panel as claimed in claim 5, wherein the volume varying means moves within the case forward toward the panel or backward away from the panel to decrease or increase the inner volume of the case.

9. The plasma display panel as claim in claim 8, wherein the volume varying means moves by rotating a circular rubber packing inserted into the case, wherein the case has a screw thread along its interior surface where the circular rubber packing moves forwards and backwards along the screw thread to vary the volume of the case.

10. The plasma display panel as claimed in claim 5, wherein the case comprises two branches, one of which is an exhaust pipe and the other one of which has the volume varying means inserted therein.

11. The plasma display panel as claimed in claim 5, wherein the panel, the case and the volume varying means are connected and the discharge gas is sealed within the panel and the case, wherein the volume varying means moves within the case to change the volume of the case and change the pressure of the discharge gas within the panel and the case.

12. The plasma display panel as claimed in claim 1, wherein the pressure adjusting means comprises a self-sealing body.

13. The plasma display panel as claimed in claim 12, wherein the self-sealing body comprises an elastic material.

14. The plasma display panel as claimed in claim 12, wherein the self-sealing body comprises rubber.

15. The plasma display panel as claimed in claim 12, wherein the self-sealing body seals an opening in the panel.

16. The plasma display panel as claimed in claim 1, wherein the pressure adjusting means is capable of readjusting the pressure after the injected discharge gas pressure is fixed by sealing the plasma display panel.

17. A plasma display panel, comprising:

a pair of substrates having a predetermined distance between them;

a plurality of first electrodes on one of the substrates;

a plurality of second electrodes on the other substrate;

barrier ribs formed on one of the substrates forming discharge cells;

discharge gas injected into the panel with a predetermined pressure; and a re-adjustable pressure adjustor connected to the panel, wherein the adjustor can fixedly adjust the predetermined pressure of the panel initially upon formation and can readjust the pressure within the panel at least one other time after initial adjustment.

18. The plasma display panel as claimed in claim 17, wherein the adjustor is fixedly attached to the panel and connected to the panel so that the discharge gas within the panel flows between the panel and the adjustor.

19. The plasma display panel as claimed in claim 17, wherein the adjustor comprises a circular rubber packing inserted into a tube having a screw thread, wherein the packing moves along the screw thread to increase or decrease the volume of the tube and therefore decrease or increase, respectively, the pressure in the plasma display panel.

20. The plasma display panel as claimed in claim 17, wherein the adjustor comprises a self-sealing body inserted into an opening connected to the discharge gas along an exterior surface of the plasma display panel, wherein a penetrating tube can be inserted into the body to inject or extract discharge gas from the plasma display panel.

21. A plasma display panel, comprising:

a pair of substrates having a predetermined distance between them;

a plurality of first electrodes on one of the substrates;

a plurality of second electrodes on the other substrate;

barrier ribs formed on one of the substrates forming discharge cells;

discharge gas injected into the panel with a predetermined pressure; and a pressure adjustor connected to the discharge gas, wherein the plasma display panel and the pressure adjustor are sealed together and the pressure of the discharge gas in the plasma display panel can be fixed and later either readjusted without breaking the seal or readjusted by breaking the seal and allowing the seal to re-seal without intervention.

22. A method of correcting for environmental effects on a plasma display panel, comprising changing an internal pressure of the plasma display panel initially set by a manufacturer.

23. The method as claimed in claim 22, wherein the changing of the internal pressure of the plasma display panel comprises moving a portion of a pressure adjusting means to change the total volume of the panel.

24. The method as claimed in claim 22, wherein the changing of the internal pressure of the plasma display panel comprises adjusting the pressure of the discharge gas by adjusting the volume and pressure of the discharge gas after the panel is sealed.

25. The method as claimed in claim 22, wherein the changing of the internal pressure of the plasma display panel comprises adjusting the pressure of the discharge gas by adjusting the pressure of the discharge gas more than once after the panel is sealed.

26. The method as claimed in claim 22, wherein the changing of the internal pressure of the plasma display panel comprises:

attaching a case to the panel; forming a movable piece within the case; and moving the movable piece within the case.

27. The method as claimed in claim 26, wherein the attaching the case to the panel comprises:

forming an opening on an exterior surface of the panel; and attaching a hollow case with an internal screw thread, wherein discharge gas from the panel flows between the panel and the case, and wherein the forming of the movable piece comprises inserting a circular rubber packing into the case.

28. The method as claimed in claim 27, wherein the changing of the internal pressure of the plasma display panel comprises turning the circular rubber packing along the screw thread to increase or decrease the volume of the case and the pressure of the discharge gas in the case and the panel.

29. The method as claimed in claim 22, wherein the changing of the internal pressure of the plasma display panel comprises:

inserting a self-sealing body into an opening on an exterior surface of the panel;

inserting a penetrating tube into the self-sealing body; and injecting or extracting discharge gas from the panel.

* * * * *